United States Patent [19]

Hoskinson

[11] 4,013,271

[45] Mar. 22, 1977

[54] MIXING DEVICE

[76] Inventor: James H. Hoskinson, 10118 Duck Creek Road, Salem, Ohio 44460

[22] Filed: Sept. 18, 1975

[21] Appl. No.: 614,628

[52] U.S. Cl. ..... 259/2; 259/7; 259/10; 259/81 R; 259/113

[51] Int. Cl.[2] ..... B01F 7/12; B01F 13/00

[58] Field of Search ..... 259/2, 7, 9, 10, 30, 259/42, 45, 46, 47, 81, 106, 109, 110, 113

[56] References Cited

UNITED STATES PATENTS

| | | | |
|---|---|---|---|
| 2,295,740 | 9/1942 | Keen | 259/7 |
| 3,073,577 | 1/1963 | Stevenson | 259/47 |

*Primary Examiner*—Richard E. Aegerter
*Assistant Examiner*—Richard R. Stearns
*Attorney, Agent, or Firm*—Webster B. Harpman

[57] ABSTRACT

A mixing device particularly adapted for mixing plastic auto body filler and hardener which react when brought together and begin to harden, has a pair of body members hinged to one another and provided with flat registering surfaces. A flat surface rotary member is mounted in one of the body members and a pair of valves are formed in the other of the body members for the delivery of the plastic materials to the flat surface of the rotary member for mixing when the same revolves. The hardened material can be easily scraped from the flat surfaces when the device is cleaned.

6 Claims, 2 Drawing Figures

MIXING DEVICE

BACKGROUND OF THE INVENTION

1. Field of the Invention:

This invention relates to mixing devices for materials such as auto body filler resins and catalysts therefor.

2. Description of the Prior Art:

No prior art is known wherein the mixing device presents limited areas of flat surfaces in opposed relation to permit ready cleaning as necessary for reuse. Prior art mixing devices incorporate blades or other agitator formations from which hardening materials are incapable of being removed, see for example U.S. Pat. Nos. 1,670,593, 2,645,464, 3,140,861, 3,220,703 and 3,330,536.

This invention provides a device which mixes the filler material and catalyst in a limited area having flat surfaces and self purging valves delivering the material thereto.

SUMMARY OF THE INVENTION

A mixing device for mixing plastic body filler and hardener such as epoxy resins or other materials which harden as a result of the introduction of a catalyst thereinto includes a pair of body members having flat registrable surfaces, one of which is a flat, rotatable member recessed slightly therein and the other of which has delivery orifices for self-cleaning slide valves through which the material is delivered to the surface of the rotatable member for mixing upon rotation thereof. The mixed material is delivered continuously from the bottom of the registering body members due to the formation of one of them with an open area adjacent the bottom of the rotary member.

DESCRIPTION OF THE PREFERRED EMBODIMENT

Figure 1:
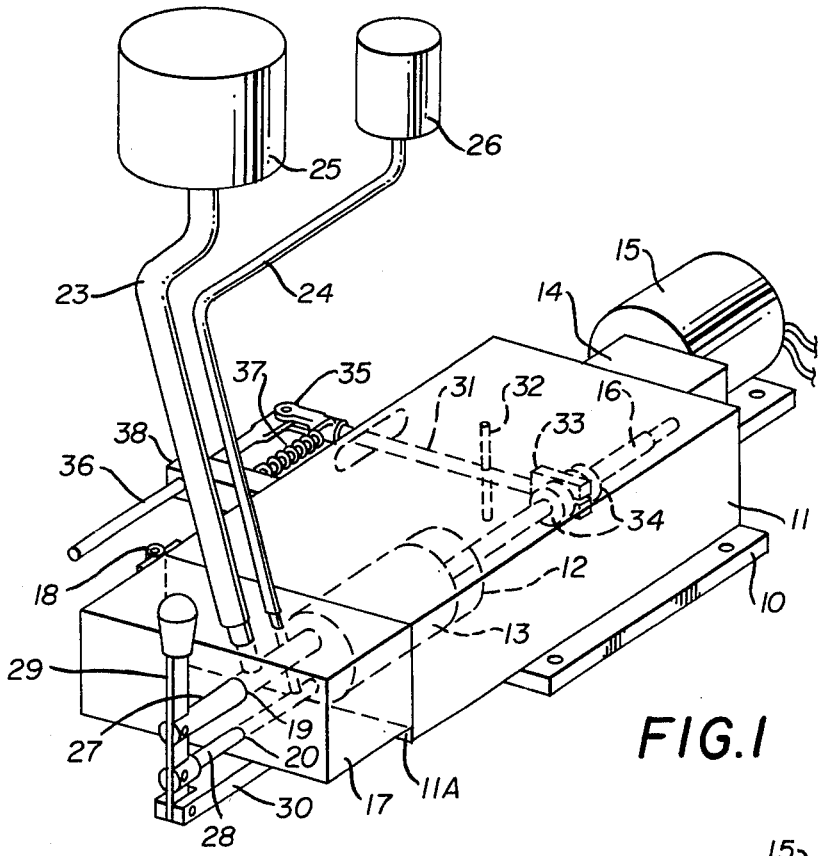
FIG. 1 is a perspective elevation of the mixing device with the parts arranged in operative relation.

In the form of the invention chosen for illustration herein, the mixing device as best seen in FIG. 1 of the drawings comprises a base 10 having a rectangular first body member 11 positioned thereon and having a cylindrical bore 12 longitudinally thereof in which a flat surfaced member 13 is rotatably and axially movable.

A gear reduction box 14 and an electric motor 15 are positioned at the right end of the first body member 11 and the gear reduction box is arranged to rotate a connecting rod 16 which extends between the flat surfaced member 13 and the gear reduction box 14 so that the flat surfaced member 13 may be revolved thereby.

Figure 2:
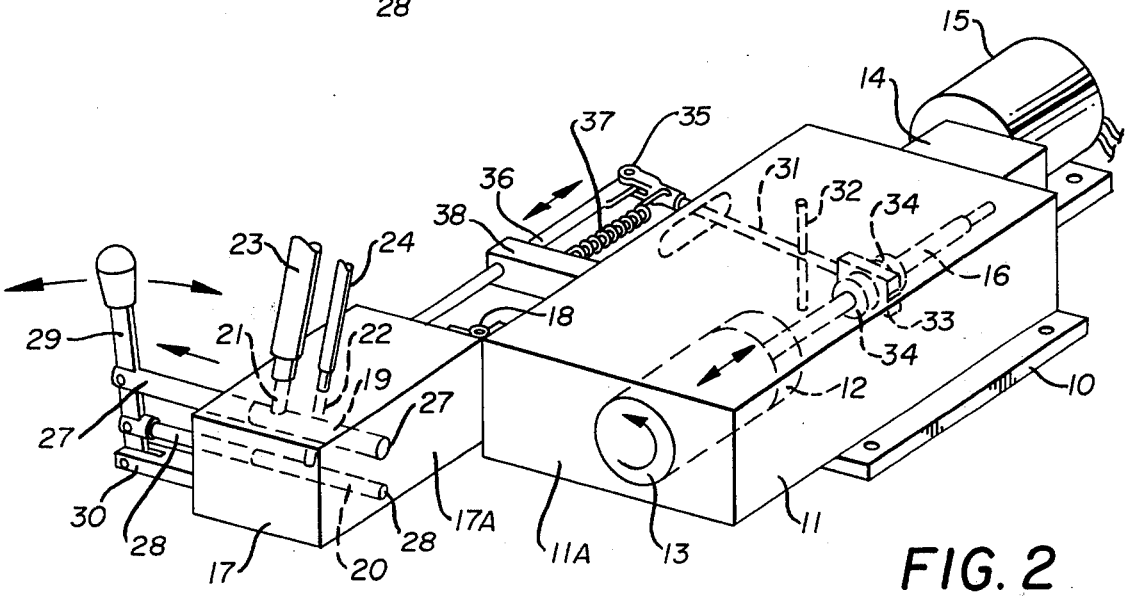
FIG. 2 is a perspective elevation of the device with parts broken away and showing the device in inoperative condition for cleaning.

A second rectangular body member 17 is hinged by a hinge 18 to the first body member 11 and as best seen in FIG. 2 of the drawings the first body member 11 and the second body member 17 have flat, registering faces 11A and 17A with the flat surface of the flat surfaced member 13 positioned in flush relation to the flat surface 11A of the first body member when the body members are in open relation as seen in FIG. 2 of the drawings. The second rectangular body member 17 has a pair of transverse bores 19 and 20 therein with the ends thereof in the surface 17A being positioned for registry with the surface of the flat surfaced member 13 when the body members 11 and 17 are in registering operating condition as seen in FIG. 1 of the drawings.

Communicating bores 21 and 22 connect with the tubular bores 19 and 20 respectively and flexible tubular members 23 and 24 connect with the communicating bores 21 and 22 respectively and extend to pressurized containers 25 and 26 as seen in FIG. 1 of the drawings wherein the body filler material and the catalyst or hardener therefore are respectively positioned.

In order that the filler material from the container 25 and the catalyst or hardener from the container 26 may be controlled and delivered in the desired quantity and ratio to the flat surface of the member 13 for mixing, slide valves 27 and 28 are positioned for longitudinal movement in the tubular bores 19 and 20 in normally closed relation with respect to the communicating bores 21 and 22.

The valves 27 and 28 extend outwardly of the opposite side of the secondary body 17 with respect to the face 17A thereof and are pivotally attached to a lever 29 which in turn is pivoted to a bracket 30 extending outwardly from the second body member 17.

It will be observed that the valve members 27 and 28 are pivoted at different locations to the lever 29 with respect to its pivoted relation to the bracket 30 and these pivotal connections are loosely arranged so that when the lever 29 is moved in an arcuate motion the valves 27 and 28 will slide longitudinally of the tubular bores 19 and 20. The tubular bores 19 and 20 are of different diameters so that different amounts of the plastic body material and catalyst or hardener therefor, and in a desired ratio, are delivered to the mixing device.

In order that the member 13 may be moved longitudinally of the cylindrical bore 12 a secondary lever 31 is pivoted to a pin 32 in the first body member 11 so that one of its ends 33, which is bifurcated, is positioned between a pair of collars 34 on the connecting rod 16 while its other end is pivoted as at 35 to an arm 36 which extends parallel with the side of the first body member 11 to a position where it will be engaged by the second body member 17 when the same is moved to open position as seen in FIG. 2 of the drawings.

By referring to FIG. 2 of the drawings, it will be seen that when this action occurs the flat surface of the member 13 moves into flush position with the face 11A of the first body 11 so that material thereon can be easily cleaned.

A spring 37 positioned between the secondary lever 31 and a bracket 38 which also guides the arm 36, normally biases the secondary lever 31 to a position moving the member 13 inwardly of the surface 11A of the body 11 approximately a thirty-second of an inch to form a shallow mixing chamber. This occurs when the second body 17 is moved into registry against the first body member 11 as seen in FIG. 1 of the drawings.

It will thus be seen that a mixing device has been disclosed in which materials which begin to harden upon being mixed can be successfully mixed and the mixing device cleaned after use as only flat readily scrapable surfaces are involved and it will occur to those skilled in the art that latch means may be incorporated for holding the body members 11 and 17 in operative engagement as seen in FIG. 1 of the drawings if desired.

Although but one embodiment of the present invention has been illustrated and described it will be apparent to those skilled in the art that various changes and modifications may be made herein without departing from the spirit of the invention or from the scope of the appended claims and having thus described my invention what I claim is:

1. A mixing device having movable first and second body members with oppositely disposed engaging surfaces, a cylindrical bore formed in said first body member inwardly from the surface thereof and a flat surfaced circular member movably positioned in said cylindrical bore, means for imparting rotational and translational motion to said circular member, said second body member having a pair of tubular bores therein extending transversely from the surface thereof and positioned for registry with the surface of said circular member in the first body member when the body members are in engaged relation, valve elements slidably disposed in said tubular bores and passageways in said second body member communicating with said tubular bores and comprising means by which materials to be mixed may be delivered thereto, said valve elements movable longitudinally of said tubular bores from first positions flush with the surface of said second body member to second positions inwardly thereof beyond said communication passageways and whereby material in said tubular bores is moved outwardly of the surface of the second body member when said valve elements close said communicating passageways.

2. The mixing device set forth in claim 1 and wherein the first and second body members are hinged to one another.

3. The mixing device set forth in claim 1 and wherein means is provided in said first body member for imparting longitudinal movement to said circular member relative to said cylindrical bore, said last named means being responsive in operation to the relative motion of said first and second body members as they are brought into and out of said engaged relationship.

4. The mixing device set forth in claim 1 and wherein said valve elements in said second body member extend outwardly of the tubular bores therein, an extension is provided on said second body member, a lever is pivoted to said extension and loosely connected to said valve elements so that the same may be simultaneously moved by said lever.

5. The mixing device of claim 1 and wherein pressurized containers for materials to be mixed are provided and flexible tubular connections extend between the same and said communicating passageways in said second body member.

6. The mixing device set forth in claim 1 and wherein the means for imparting rotary motion to the circular member comprises a gear box and an electric motor for driving the same together with a connecting shaft extending from said gear box to said circular member.

* * * * *